US011310881B1

(12) United States Patent
Wu et al.

(10) Patent No.: US 11,310,881 B1
(45) Date of Patent: Apr. 19, 2022

(54) SYNCHRONOUS CONTROL SYSTEM OF LIGHT BULBS AND SYNCHRONOUSLY CONTROLLED LIGHT BULBS

(71) Applicant: ZHANGZHOU GO WIN LIGHTING CO., LTD, Zhangzhou (CN)

(72) Inventors: Qingan Wu, Zhangzhou (CN); Yaying Huang, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 17/396,750

(22) Filed: Aug. 8, 2021

(30) Foreign Application Priority Data

Jun. 25, 2021 (CN) ..... 202110711573.5
Jun. 25, 2021 (CN) ..... 202121434548.9

(51) Int. Cl.
*H05B 45/37* (2020.01)
*H05B 47/155* (2020.01)
*H05B 45/46* (2020.01)

(52) U.S. Cl.
CPC ..... *H05B 45/37* (2020.01); *H05B 45/46* (2020.01); *H05B 47/155* (2020.01)

(58) Field of Classification Search
CPC ..... H05B 45/37; H05B 45/46; H05B 47/155
See application file for complete search history.

(56) References Cited

U.S. PATENT DOCUMENTS

2011/0291583 A1* 12/2011 Shen ..... H05B 45/10 315/287
2015/0257211 A1* 9/2015 Johnson ..... H05B 45/00 315/121
2015/0312987 A1* 10/2015 Gibbs ..... H05B 45/14 315/122
2019/0141816 A1* 5/2019 Zhu ..... H05B 45/20

* cited by examiner

*Primary Examiner* — Minh D A

(57) ABSTRACT

A synchronous control system of light bulbs includes a rectifier unit connected to a live line and a neutral line of an external power supply, a sampling unit connected to the rectifier unit or the external power supply to count a number of changes in a cycle and obtain a cycle length of the alternating current or a control signal pulse, so as to provide a synchronization signal and acquire a control signal input by an external controller, a control unit for receiving the synchronization signal and control the synchronization signal and/or control signal output by the sampling unit, an MCU power supply unit respectively connected to the rectifier unit and the control unit to supply power to the control unit, and LED assembly including one or more LED units which is respectively connected to the rectifier unit and the control unit and controlled by the control unit.

7 Claims, 2 Drawing Sheets

SYNCHRONOUS CONTROL SYSTEM OF LIGHT BULBS AND SYNCHRONOUSLY CONTROLLED LIGHT BULBS

CROSS-REFERENCE TO RELATED APPLICATIONS

This application is based upon and claims priority to Chinese Patent Applications No. 202110711573.5 and No. 202121434548.9, filed on Jun. 25, 2021, the entire contents of which are incorporated herein by reference.

TECHNICAL FIELD

The present disclosure relates to the field of light bulbs and control device thereof, in particular to a synchronous control system of light bulbs and synchronously controlled light bulbs.

BACKGROUND

As an important lighting instrument, light bulbs are widely used in indoor decorations, atmosphere creation in public places, etc. Because decorative light bulbs are mostly composed of multiple LED lights connected in series, in order to enable LED lights to be controlled synchronously according to a certain rule, under normal circumstances, light bulb control system will be configured by the designer according to corresponding functional requirements, such as light intensity adjustment, sequential illumination of lights, etc.

Traditionally, control units are configured according to the number of LED lights. However, since the multiple control units are not synchronized, the responses of the LED lights respectively controlled by the control units are also not synchronized, so that as time goes on, the timing deviation of different control units accumulates, the lighting of the light bulbs becomes irregular. Although multiple LED light bulbs controlled by one control chip already exist in the market, once the controller connected by the user is removed, the LED lights will work in disorder, and automatic adjustment to light in order cannot be realized.

SUMMARY

In view of the background, the objective of the present disclosure is to provide a synchronous control system of light bulbs and synchronously controlled light bulbs that are reliable in implementation with high synchronization efficiency and good stability.

In order to achieve the above technical objectives, the technical solutions adopted by the present disclosure are as follows.

A synchronous control system of light bulbs includes: a rectifier unit connected to a live line and a neutral line of an external power supply, wherein the rectifier unit is configured to convert an alternating current into a direct current; a synchronization signal and control signal sampling unit connected to the rectifier unit or the external power supply, wherein the synchronization signal and control signal sampling unit is configured to count a number of changes in a cycle and a cycle length of the alternating current or a control signal pulse to provide a synchronization signal and acquire a control signal input by an external controller; a control unit connected to the synchronization signal and control signal sampling unit, wherein the control unit is configured to receive the synchronization signal and control the synchronization signal and/or control signal output by the synchronization signal and control signal sampling unit; an MCU power supply unit respectively connected to the rectifier unit and the control unit, wherein the MCU power supply unit is configured to supply power to the control unit; and an LED assembly including one or more LED units, wherein the LED assembly is respectively connected to the rectifier unit and the control unit, and is controlled by the control unit.

As an optional implementation, a fuse F1 and a current-limiting resistor R1 are respectively connected to the live line and the neutral line between the external power supply and the rectifier unit.

As an optional implementation, the rectifier unit is a rectifier bridge DB1, and a first pin and a third pin of the rectifier bridge are respectively connected to the live line and the neutral line of the external power supply. Two ends of the fuse F1 are connected to a line connecting the first pin of the rectifier bridge DB1 and the external power supply. Two ends of the current-limiting resistor R1 are connected to a line connecting the third pin of the rectifier bridge DB1 and the external power supply. A fourth pin of the rectifier bridge DB1 is grounded, and a second pin of the rectifier bridge DB1 is respectively connected to the MCU power supply unit, the synchronization signal and control signal sampling unit, and the LED assembly.

Optionally, a line connecting the second pin of the rectifier bridge DB1 and the LED assembly is further sequentially provided with a diode D1 and a resistor R4. An anode of the diode D1 is connected to the second pin of the rectifier bridge DB1, a cathode of the diode D1 is connected to a first end of the resistor R4, and a second end of the resistor R4 is connected to the LED assembly. Further, the MCU power supply unit is connected to a line connecting the diode D1 and the resistor R4.

Optionally, the control unit includes a control chip U1. The MCU power supply unit includes a Zener diode ZD1 and a capacitor C4. A VDD pin of the control chip U1, a cathode of the Zener diode ZD1, and a first end of the capacitor C4 are all connected to the line connecting the diode D1 and the resistor R4. A GND pin of the control chip U1, an anode of the Zener diode ZD1, and a second end of capacitor C4 are all grounded. A SYN pin of the control chip U1 is connected to the synchronization signal and control signal sampling unit. The control chip U1 further includes multiple output pins, and the control chip U1 is connected to the LED assembly through the output pins.

Optionally, the synchronization signal and control signal sampling unit includes a resistor R2, a resistor R3, and a capacitor C3. A first end of the resistor R3 is connected to the second pin of the rectifier DB1, and a second end of the resistor R3, a first end of the resistor R2, a first end of the capacitor C3 are all connected to the SYN pin of the control chip U1, and a second end of the resistor R2 and a second end of the capacitor C3 are both grounded.

Optionally, a number of the LED unit is 4, and the four LED units each have an end connected to the second end of the resistor R4.

The output pins of the control chip U1 include a first output pin OUT1, a second output pin OUT2, a third output pin OUT3, and a fourth output pin OUT4, and the four LED units each have an end connected to one of the first output pin OUT1, the second output pin OUT2, the third output pin OUT3, and the fourth output pin OUT4.

Optionally, a product model of the control chip U1 is FT60F021-RB.

Optionally, the LED unit is a single color LED unit or a mixed color LED unit, and the mixed color LED unit is an RGB LED unit or an RGBW LED unit.

Optionally, the LED units of the LED assembly are connected in series, in parallel, or both.

Based on the above-mentioned solution of the light bulb control system, the present disclosure, in another aspect, provides a synchronously controlled light bulb, which includes the above-mentioned synchronous control system of light bulbs.

Comparing with the prior art, the present disclosure has the following advantages. In the present disclosure, the synchronization signal and control signal sampling unit is used to count the number of changes in a cycle and obtain a cycle length of the alternating current, so as to provide synchronization signals and acquire the control signal input by the external controller which are then transmitted to the control unit. The control unit performs automatic detection and identification to determine whether there is a control signal from the external controller. By doing so, the LED assembly is automatically controlled and adjusted in synchronous, so the LED units of the LED assembly can maintain a reliable, stable synchronous work. Meanwhile, according to the present disclosure, a diode D1 is provided to prevent distortion of the signal waveform caused by a crosstalk between the external control signal and the external power supply lines, thereby improving the stability and accuracy of the LED light assembly control.

BRIEF DESCRIPTION OF THE DRAWINGS

In order to clearly explain the embodiments of the present disclosure or the technical solutions in the prior art, the drawings that would be used in describing the embodiments or the prior art will briefly introduced below. Obviously, the drawings illustrated below merely includes some of the embodiments of the present disclosure. For those of ordinary skill in the art, other drawings may be derived based on these drawings without creative effort.

DETAILED DESCRIPTION OF THE EMBODIMENTS

The present disclosure will be described in detail with reference to the drawings and embodiments hereinafter. It should be noted that the embodiments described below are merely intended to illustrate the present disclosure rather than limit the scope of protection of the present disclosure. Likewise, the following embodiments merely cover part of the embodiments of the present disclosure rather than all. All other embodiments derived by a person of ordinary skill in the art based on the present disclosure without creative effort shall be considered as fall within the scope of the present disclosure.

Embodiment 1

Figure 1:
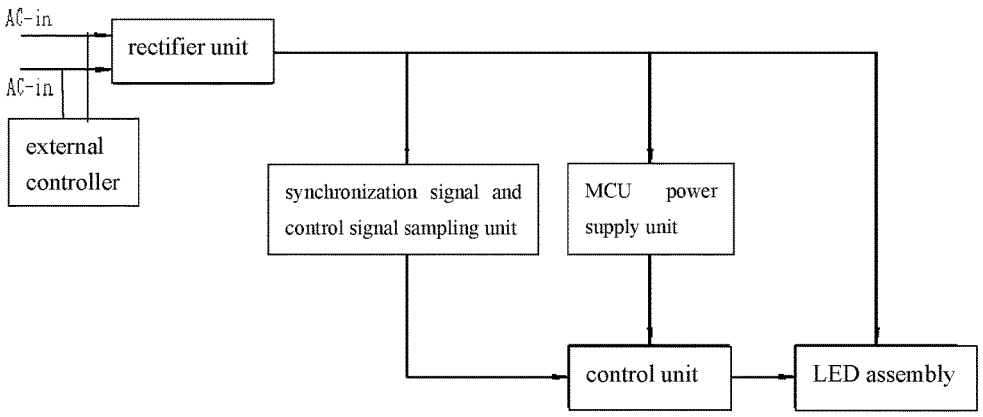
FIG. 1 is a schematic connection diagram of a synchronization control system of light bulbs according to embodiment 1 of the present disclosure.
Figure 2:
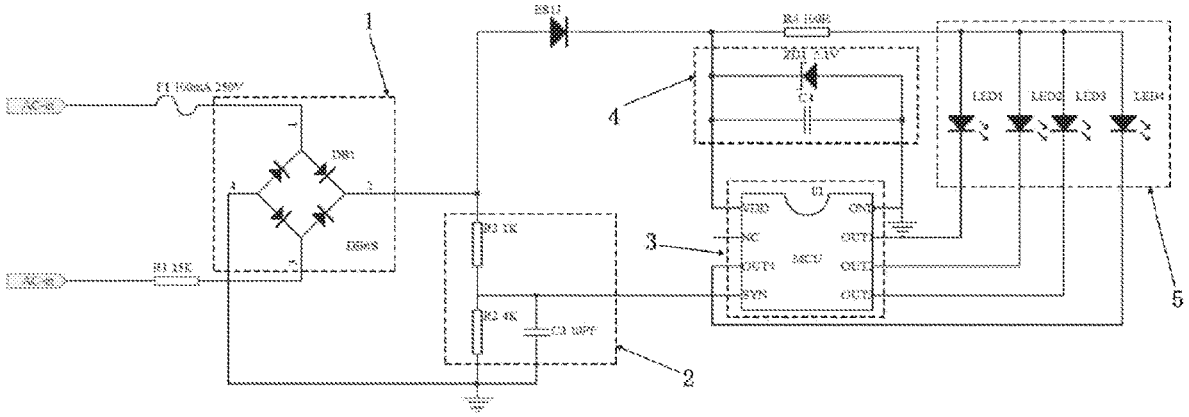
FIG. 2 is a schematic wiring diagram of the synchronization control system of light bulbs according to embodiment 1 of the present disclosure.

As shown in FIG. 1 or FIG. 2, a synchronous control system of light bulbs of the present disclosure includes: a rectifier unit 1 connected to a live line and a neutral line of an external power supply, wherein the rectifier unit 1 is configured to convert alternating current into direct current; a synchronization signal and control signal sampling unit 2 connected to the rectifier unit 1, wherein the synchronization signal and control signal sampling unit 2 is configured to count a number of changes in a cycle and obtain a cycle length of the alternating current or a control signal pulse to provide a synchronization signal and acquire a control signal input by an external controller; a control unit 3 connected to the synchronization signal and control signal sampling unit 2, wherein the control unit 3 is configured to receive the synchronization signal and control the synchronization signal and/or control signal output by the synchronization signal and control signal sampling unit 2; a microcontroller (MCU) power supply unit 4 respectively connected to the rectifier unit 1 and the control unit 3, wherein the MCU power supply unit 4 is configured to supply power to the control unit 3; and an LED assembly 5 including one or more LED units connected in parallel, wherein the LED assembly 5 is respectively connected to the rectifier unit 1 and the control unit 3, and is controlled by the control unit 3.

The aforementioned external controller is connected to the external power supply to input control signals to the synchronous control system.

As an optional implementation, based on the connection diagram shown in FIG. 1, further referring to FIG. 2, in order to improve the stability of current, a fuse F1 and a current-limiting resistor R1 are respectively connected to the live line and the neutral line between the external power supply and the rectifier unit 1. The rectifier unit 1 is a rectifier bridge DB1, and a first pin and a third pin of the rectifier bridge DB1 are respectively connected to the live line and the neutral line of the external power supply. Two ends of the fuse F1 are connected to a line connecting the first pin of the rectifier bridge DB1 and the external power supply. The fuse F1 mainly works to provide current protection to avoid short circuits in the control system caused by overloads. Two ends of the current-limiting resistor R1 are connected to a line connecting the third pin of the rectifier bridge DB1 and the external power supply. A fourth pin of the rectifier bridge DB1 is grounded, and a second pin of the rectifier bridge DB1 is respectively connected to the MCU power supply unit, the synchronization signal and control signal sampling unit, and the LED assembly.

Optionally, a line connecting the second pin of the rectifier bridge DB1 and the LED assembly is further sequentially provided with a diode D1 and a resistor R4. An anode of the diode D1 is connected to the second pin of the rectifier bridge DB1, a cathode of the diode D1 is connected to a first end of the resistor R4, and a second end of the resistor R4 is connected to the LED assembly. The diode D1 mainly works to prevent the waveform distortion of the control signal caused by the crosstalk between the control signal and the external power supply line which affects the reliability of controlling the LED assembly 5. Further, the MCU power supply unit 4 is connected to a line connecting the diode D1 and the resistor R4.

Optionally, the control unit 3 includes a control chip U1. The product model of the control chip may be FT60F021-RB. The MCU power supply unit 4 includes a Zener diode ZD1 and a capacitor C4. A VDD pin of the control chip U1, a cathode of the Zener diode ZD1, and a first end of the capacitor C4 are all connected to the line connecting the diode D1 and the resistor R4. A GND pin of the control chip U1, an anode of the Zener diode ZD1, and a second end of capacitor C4 are all grounded. A SYN pin of the control chip U1 is connected to the synchronization signal and control signal sampling unit 2. The control chip U1 further includes multiple output pins, and the control chip U1 is connected to the LED assembly 5 through the output pins.

Optionally, the synchronization signal and control signal sampling unit 2 includes a resistor R2, a resistor R3, and a capacitor C3. A first end of the resistor R3 is connected to the second pin of the rectifier DB1, and a second end of the resistor R3, a first end of the resistor R2, a first end of the capacitor C3 are all connected to the SYN pin of the control chip U1, and a second end of the resistor R2 and a second end of the capacitor C3 are both grounded.

Optionally, a number of the LED unit is 4, and the four LED units are connected in parallel. The four LED units each have an end connected to the second end of the resistor R4. The output pins of the control chip U1 include a first output pin OUT1, a second output pin OUT2, a third output pin OUT3, and a fourth output pin OUT4, and the four LED units each have an end connected to one of the first output pin OUT1, the second output pin OUT2, the third output pin OUT3, and the fourth output pin OUT4.

Optionally, the LED unit is a single color LED unit or a mixed color LED unit, and the mixed color LED unit is an RGB LED unit or an RGBW LED unit.

The work principle of the above mentioned embodiment is as follows.

In this solution, the SYN pin of the control chip U1 is used to detect a value of the voltage dividing signal of the resistor R3 and the resistor R2 to determine whether there is a control signal input.

When there is no external controller connected by the user, the synchronization signal and control signal sampling unit counts the number of changes in a cycle and obtain a cycle length of the alternating current to provide the synchronization signal to the SYN pin of the control chip U1, and the SYN pin of the control chip U1 will automatically detect and determine frequency of the AC input signal to realize the synchronous control of the LED units on the same line.

When an external controller is connected by the user, the synchronization signal and control signal sampling unit acquires the control signal and provides the control signal to the SYN pin of the control chip U1. The SYN pin of the control chip U1 will automatically detect and identify the function of the control signal and can automatically identify the output signal of the external controller, so as to realize that the same control unit 3 is shared with the LED units to realize unified and synchronous control of the color change of the LED units.

Embodiment 2

Figure 3:
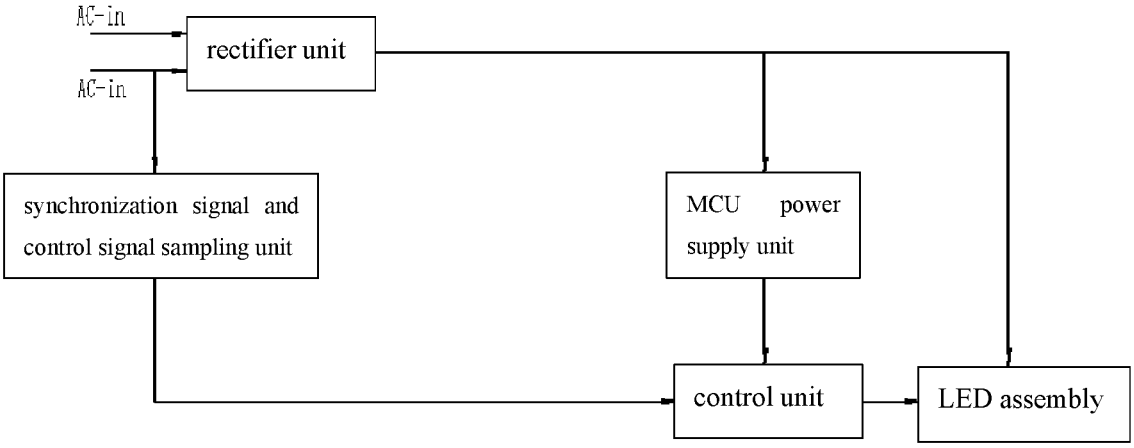
FIG. 3 is a schematic connection diagram of a synchronization control system of light bulbs according to embodiment 2 of the present disclosure.

As shown in FIG. 3, this embodiment is basically the same as Embodiment 1, and the difference is that in this embodiment, the synchronization signal and control signal sampling unit is directly connected to the external power supply for counting the number of changes in a cycle and obtain a cycle length of the alternating current or the control signal pulses to provide synchronization signals and acquire control signals input by the external controller.

The rest of the connection relations and general control mechanism of this embodiment are substantially the same as those of Embodiment 1, and will not be repeated hereinafter.

The above descriptions merely include part of the embodiments of the present disclosure, and the scope of protection of the present disclosure is not limited to these embodiments. Any equivalent device or equivalent process transformation made based on the content of the description and drawings of the present disclosure, or direct or indirect application of the present disclosure to other related technical fields should be considered as fall within the scope of the present disclosure.

What is claimed is:

1. A synchronous control system of light bulbs comprising:

a rectifier unit connected to a live line and a neutral line of an external power supply, wherein the rectifier unit is configured to convert an alternating current into a direct current;

a synchronization signal and control signal sampling unit connected to the rectifier unit or the external power supply, wherein the synchronization signal and control signal sampling unit is configured to count a number of changes in a cycle and obtain a cycle length of the alternating current or a control signal pulse to provide a synchronization signal and acquire a control signal input by an external controller connected to the external power supply;

a control unit connected to the synchronization signal and control signal sampling unit, wherein the control unit is configured to receive the synchronization signal and control the synchronization signal and/or control signal output by the synchronization signal and control signal sampling unit;

a microcontroller (MCU) power supply unit respectively connected to the rectifier unit and the control unit, wherein the MCU power supply unit is configured to supply power to the control unit;

an LED assembly including one or more LED units, wherein the LED assembly is respectively connected to the rectifier unit and the control unit, and the LED assembly is controlled by the control unit;

a fuse and a current-limiting resistor are respectively connected to the live line and the neutral line between the external power supply and the rectifier unit;

the rectifier unit is a rectifier bridge, and a first pin and a third pin of the rectifier bridge are respectively connected to the live line and the neutral line of the external power supply;

two ends of the fuse are connected to a line connecting the first pin of the rectifier bridge and the external power supply;

two ends of the current-limiting resistor R1 are connected to a line connecting the third pin of the rectifier bridge and the external power supply; and a fourth pin of the rectifier bridge is grounded, and a second pin of the rectifier bridge is respectively connected to the MCU power supply unit, the synchronization signal and control signal sampling unit, and the LED assembly, wherein a line connecting the second pin of the rectifier bridge and the LED assembly is sequentially provided with a diode and a fourth resistor; an anode of the diode is connected to the second pin of the rectifier bridge, a cathode of the diode is connected to a first end of the fourth resistor, and a second end of the fourth resistor is connected to the LED assembly; and the MCU power supply unit is connected to a line connecting the diode and the fourth resistor.

2. The synchronous control system of light bulbs according to claim 1, wherein the control unit comprises a control chip, the MCU power supply unit comprises a Zener diode and a fourth capacitor; and a VDD pin of the control chip, a cathode of the Zener diode, and a first end of the fourth capacitor are all connected to the line connecting the diode and the fourth resistor, a GND pin of the control chip, an anode of the Zener diode, and a second end of the fourth capacitor are all grounded, a SYN pin of the control chip is connected to the synchronization signal and control signal sampling unit, the control chip further comprises multiple output pins, and the control chip is connected to the LED assembly through the output pins.

3. The synchronous control system of light bulbs according to claim 2, wherein the synchronization signal and control signal sampling unit comprises a second resistor, a third resistor, and a third capacitor, a first end of the third resistor is connected to the second pin of the rectifier, and a second end of the third resistor, a first end of the second resistor, a first end of the third capacitor are all connected to the SYN pin of the control chip, and a second end of the second resistor and a second end of the third capacitor are both grounded.

4. The synchronous control system of light bulbs according to claim 3, wherein a number of the LED unit is 4, and the four LED units each have an end connected to the second end of the fourth resistor; and the output pins of the control chip comprise a first output pin, a second output pin, a third output pin, and a fourth output pin, and the four LED units each have an end connected to one of the first output pin, the second output pin, the third output pin, and the fourth output pin.

5. The synchronous control system of light bulbs according to claim 2, wherein a product model of the control chip is FT60F021-RB.

6. The synchronous control system of light bulbs according to claim 1, wherein the LED unit is a single color LED unit or a mixed color LED unit, and the mixed color LED unit is an RGB LED unit or an RGBW LED unit.

7. A synchronously controlled light bulb comprising a synchronous control system, wherein the synchronously controlled light bulb is controlled by the synchronous control system and the synchronous control system comprises:

a rectifier unit connected to a live line and a neutral line of an external power supply, wherein the rectifier unit is configured to convert an alternating current into a direct current;

a synchronization signal and control signal sampling unit connected to the rectifier unit or the external power supply, wherein the synchronization signal and control signal sampling unit is configured to count a number of periodic changes and a number of periods of the alternating current or a control signal pulse to provide a synchronization signal and acquire a control signal input by an external controller connected to the external power supply;

a control unit connected to the synchronization signal and control signal sampling unit, wherein the control unit is configured to receive the synchronization signal and control the synchronization signal and/or control signal output by the synchronization signal and control signal sampling unit;

an MCU power supply unit respectively connected to the rectifier unit and the control unit, wherein the MCU power supply unit is configured to supply power to the control unit;

an LED assembly including one or more LED units, wherein the LED assembly is respectively connected to the rectifier unit and the control unit, and the LED assembly is controlled by the control unit;

a fuse and a current-limiting resistor are respectively connected to the live line and the neutral line between the external power supply and the rectifier unit;

the rectifier unit is a rectifier bridge, and a first pin and a third pin of the rectifier bridge are respectively connected to the live line and the neutral line of the external power supply;

two ends of the fuse are connected to a line connecting the first pin of the rectifier bridge and the external power supply;

two ends of the current-limiting resistor R1 are connected to a line connecting the third pin of the rectifier bridge and the external power supply; and a fourth pin of the rectifier bridge is grounded, and a second pin of the rectifier bridge is respectively connected to the MCU power supply unit, the synchronization signal and control signal sampling unit, and the LED assembly, wherein a line connecting the second pin of the rectifier bridge and the LED assembly is sequentially provided with a diode and a fourth resistor; an anode of the diode is connected to the second pin of the rectifier bridge, a cathode of the diode is connected to a first end of the fourth resistor, and a second end of the fourth resistor is connected to the LED assembly; and the MCU power supply unit is connected to a line connecting the diode and the fourth resistor.

* * * * *